US006450061B1

(12) United States Patent
Chapman et al.

(10) Patent No.: US 6,450,061 B1
(45) Date of Patent: Sep. 17, 2002

(54) ADJUSTABLE PEDAL SYSTEM WITH MISALIGNMENT SENSOR

(75) Inventors: David Joseph Chapman; Waldemar Wawrzyniec Gmurowski, both of Sterling Heights, MI (US)

(73) Assignee: Delphi Technologies, Inc., Troy, MI (US)

( * ) Notice: Subject to any disclaimer, the term of this patent is extended or adjusted under 35 U.S.C. 154(b) by 86 days.

(21) Appl. No.: 09/640,384

(22) Filed: Aug. 16, 2000

Related U.S. Application Data

(60) Provisional application No. 60/155,750, filed on Sep. 23, 1999.

(51) Int. Cl.[7] ..... G05G 1/14

(52) U.S. Cl. ..... 74/512; 74/513; 74/514

(58) Field of Search ..... 74/512, 513, 560, 74/522, 89.28, 89.37; 180/334, 326

(56) References Cited

U.S. PATENT DOCUMENTS

| | | | | |
|---|---|---|---|---|
| 3,643,525 A | | 2/1972 | Gibas | |
| 4,870,871 A | | 10/1989 | Van | |
| 5,351,573 A | * | 10/1994 | Cicotte | 74/512 |
| 5,460,061 A | | 10/1995 | Reading et al. | |
| 5,632,183 A | * | 5/1997 | Rixon et al. | 74/512 |
| 5,722,301 A | | 3/1998 | Schaaphok | |
| 5,823,064 A | * | 10/1998 | Cicotte | 74/512 |
| 5,890,399 A | * | 4/1999 | Rixon et al. | 74/512 |
| 5,937,707 A | * | 8/1999 | Rixon et al. | 74/512 |
| 6,151,984 A | * | 11/2000 | Johansson et al. | 180/334 |
| 6,189,409 B1 | * | 2/2001 | Neag et al. | 74/512 |
| 6,324,939 B1 | * | 12/2001 | Cicotte | 74/512 |

FOREIGN PATENT DOCUMENTS

| | | |
|---|---|---|
| DE | 199 47 500 | 5/2001 |
| EP | 1 120 700 | 8/2001 |

* cited by examiner

*Primary Examiner*—Rodney H Bonck
*Assistant Examiner*—David D. Le
(74) *Attorney, Agent, or Firm*—Kathryn A. Marra

(57) ABSTRACT

An adjustable pedal system has a first pedal pivotally attached to the translatable nut of a first jack screw actuator for adjusting the fore and aft position of the first pedal and a second pedal pivotally attached to the translatable nut of a second jack screw actuator for adjusting the fore and aft position of the second pedal and a third pedal pivotally attached to the translatable nut of a third jack screw actuator for adjusting the fore and aft position of the third pedal. An electric motor drives the translatable nuts fore and aft, and a motor control switch assembly controlled by the fore and aft movements of two of the nuts maintain alignment of the three pedals. A memory circuit may be incorporated into the system for moving the pedals to a preselected adjusted position or indicating the preselected adjusted position. The memory circuit may be separate or incorporated in a seat memory module.

20 Claims, 3 Drawing Sheets

ADJUSTABLE PEDAL SYSTEM WITH MISALIGNMENT SENSOR

RELATED PATENT APPLICATIONS

The benefit of the filing date of Provisional Patent Application 60/155 750 filed Sep. 23, 1999 is claimed.

FIELD OF THE INVENTION

This invention relates to an adjustable pedal system for an automobile.

BACKGROUND OF THE INVENTION

Adjustable pedal systems are known in the art. These adjustable pedal systems allow the driver to adjust the position of the brake and accelerator pedals (and clutch pedal in automobiles with manual transmissions) fore and aft for greater comfort and for greater distance from a steering wheel mounted air bag.

These adjustable pedal systems often comprise a jack screw actuator for each adjustable pedal and in some instances the rotary screws, also known as threaded members, of several jack screw actuators are rotated by a common power source, such as an electric motor. See for instance, U.S. Pat. No. 4,870,871 granted to Steve D. Ivan Oct. 3, 1989; U.S. Pat. No. 5,460,061 granted to Harry L. Redding et al Oct. 24, 1995 and U.S. Pat. No. 5,722,302 granted to Christopher J. Rixon et al Mar. 3, 1998.

The Redding '061 patent and the Rixon '302 patent both disclose arrangements that have two flexible, torsionally rigid cables that transfer drive from a single power source, an electric motor, to two jack screws, each of which adjusts a different pedal. A drawback of these adjustable pedals system is that one pedal can be adjusted white the other pedal remains stationary if one of the power transfer cables breaks. This results in pedal misalignment which in turn may result in an awkward and uncomfortable operation for the vehicle driver.

SUMMARY OF THE INVENTION

The adjustable pedal system of this invention uses a single electric motor that drives a plurality of jack screw actuators with flexible, but torsionally rigid, cables. Each pedal is driven by one of the jack screw actuators that is driven by one of the cables. An aligned fore—aft location of the various pedals, such as the accelerator pedal and the brake pedal (i.e. pedal step-over) must be maintained within certain desirable limits. The adjustable pedal system of the invention maintains the fore—aft alignment of the various pedals by controlling the electric motor with a switch that is mechanically connected to the adjustable pedals; the switch being operated when the adjustable pedals are out of alignment to de-energize the electric motor. This feature prevents pedal misalignment during the adjustment process even if one of the drive cables breaks so that one of the pedals is not moved by its associated jack screw actuator during the adjustment process.

BRIEF DESCRIPTION OF THE DRAWINGS

The presently preferred embodiment of the invention is disclosed in the following description and in the accompanying drawings, wherein.

DETAILED DESCRIPTION OF PREFERRED EMBODIMENT

Figure 1:
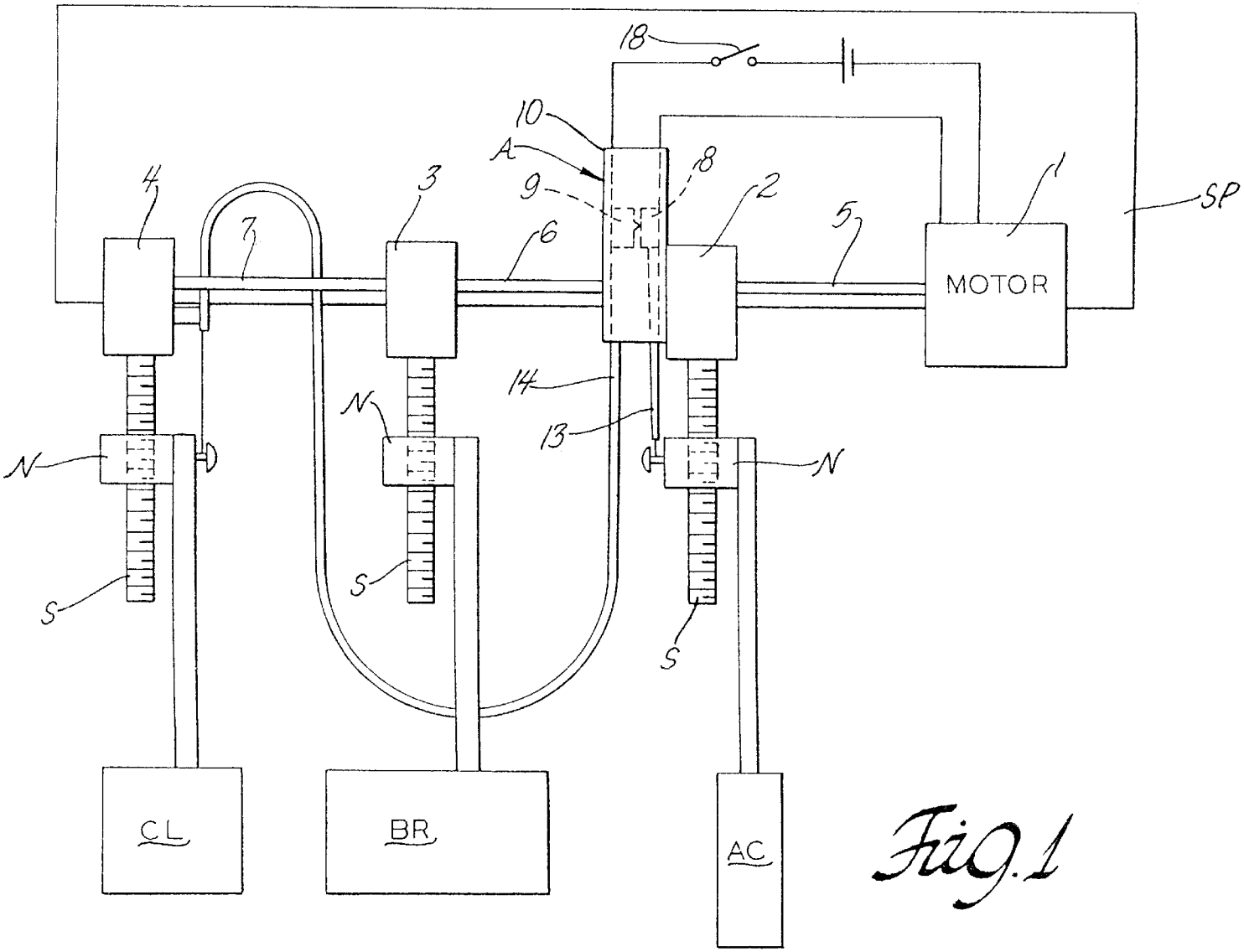
FIG. 1 is a schematic plan view of an adjustable pedal system in accordance with the invention.

Referring now to the drawing, FIG. 1 is a schematic plan view an adjustable pedal system of the invention comprising an accelerator pedal AC and a brake pedal BR which are commonly used in all automobiles. This system also includes a clutch pedal CL which is commonly used in an automobile with a manual transmission. These pedals control the engine throttle, the vehicle brakes and the clutch through suitable linkages that are not shown because any suitable linkage may be used. The pedals in turn are all controlled by foot and leg movements of the vehicle driver. The positioning of the pedals with respect to the driver is important to the comfort of the driver. The adjustable pedal system allows the driver to position the pedals fore and aft for greater comfort and for greater distance from a steering wheel mounted air bag.

Pedal adjustment in the system of the invention is done by a single electric motor 1 that drives jack screw actuators 2, 3 and 4 with flexible, but torsionally rigid, cables 5, 6 and 7 as shown in FIG. 1. Motor 1 and jack screw operators 2, 3 and 4 are mounted on a support SP that may be part of a vehicle body or a bracket attached to the vehicle body. Each pedal is adjusted by one of the jack screw actuators which is turn is driven by at least one of the flexible cables. For instance, accelerator pedal AC is adjusted by jack screw actuator 2 which in turn is driven by cable 5 which in turn is driven directly by motor 1. On the other hand, clutch pedal CL is adjusted by jack screw actuator 4 which is driven by cable 7 which in turn is indirectly driven by motor 1 via actuators 2 and 3 and cables 5 and 6. Motor 1 could be replaced by a motor having a drive shaft at each end and repositioned, for instance between actuators 2 and 3 thereby shortening the drive line to actuator 4. In any event, each pedal is driven by its own actuator which in turn is driven by at least one cable.

Jack screw actuators are well know in the art and need not be described in detail. Suffice it to state that each jack screw actuator has a nut N that is translated fore or aft with respect to the screw when the screw S is rotated one way or the other. Pedals AC, BR, and CL are pivotally mounted on the nuts N of the respective jack screw actuators 2, 3 and 4 so that the three pedals move fore or aft in unison when jack screw actuators 2, 3 and 4 are driven by the common electric motor 1.

As indicated above, the fore—aft alignment of the various pedals (pedal step-over) must be maintained within certain desirable limits. It is conceivable that the flexible cable 6 or 7 could break. If this occurred, accelerator pedal AC could move fore or aft during the adjustment process while clutch pedal CL and/or brake pedal BR remained stationery.

The adjustable pedal system of the invention maintains the fore-aft alignment of the various pedals by controlling the electric motor 1 with a normally closed switch that is mechanically connected to the adjustable pedals; the switch being opened when the adjustable pedals are out of alignment to de-energize the electric motor 1. This feature prevents pedal misalignment during the adjustment process even if one of the drive cables breaks so that one of the pedals is not moved by its associated jack screw actuator during the adjustment process.

Figure 2:
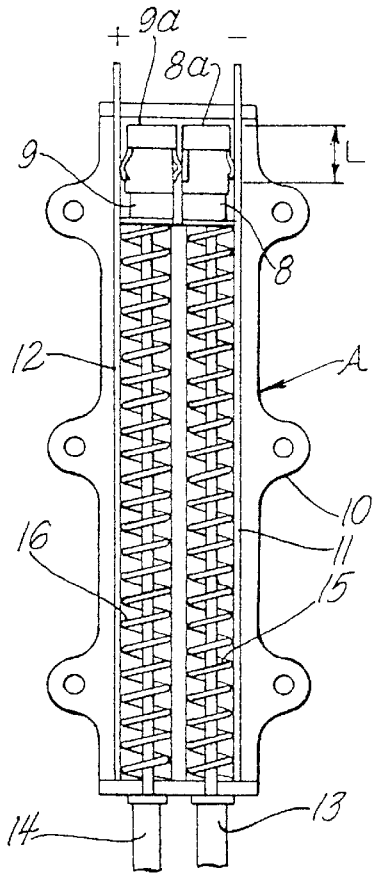
FIG. 2 is an enlarged view of a switch component of the adjustable pedal system that is shown in FIG. 1.
Figure 3:
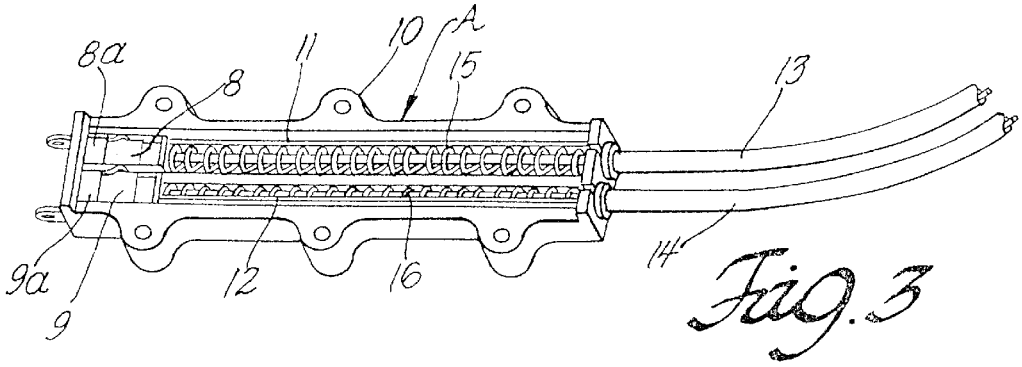
FIG. 3 is a perspective view of the switch component that is shown in FIG. 2.

The switch is part of a switch assembly A that comprises slides 8 and 9 inside a housing 10 that has two conducting rails 11 and 12 as best shown in FIGS. 2 and 3. Slides 8 and 9 have conducting portions 8*a* and 9*a* respectively that engage conducting rails 11 and 12 respectively. Conducting portions 8*a* and 9*a* also contact each other when slides 8 and 9 are aligned as shown in FIG. 2.

Slides 8 and 9 move side-by-side in housing 10. Slides 8 and 9 are mechanically connected to the respective translatable nuts N of jack screw actuators 2 and 4 by pull cables 13 and 14 respectively. Slides 8 and 9 are spring biased toward a closed end of housing 10 by respective coil return springs 15 and 16 that are arranged on parallel centerlines in housing 10. During normal operation, slides 8 and 9 are pulled away from the closed end of housing 10 in unison as the pedals 2, 3 and 4 are moved in unison toward the driver by electric motor 1 during the adjustment process. Conducting portions 8*a* and 9*a* contact each other and the respective conducting rails 11 and 12 thus maintaining the motor control circuit shown in FIG. 1 closed after an on-off pedal position adjustment switch 18 has been closed for the adjustment process. However, if either cable 6 or cable 7 is broken, slide 9 does not move and hence conducting portions 8*a* and 9*a* will disengage after slide 8 has moved a predetermined distance. Disengagement opens the motor control circuit and de-energizes electric motor 1. The system works in substantially the same way in the opposite direction, i.e. when the slides 8 and 9 are being moved under the action of return coil springs 15 and 16. In this direction, slide 9 does not move when either cable 6 or cable 7 is broken while slide 8 moves under the action of return spring 15.

Figure 5:
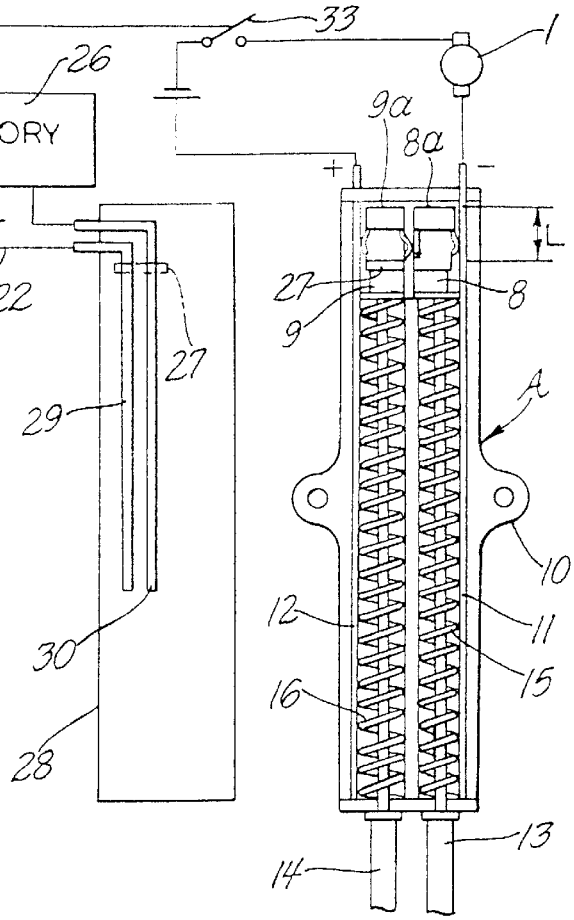
FIG. 5 is an enlarged view of switch and memory circuit components of the adjustable pedal system that is shown in FIG. 4.
Figure 4:
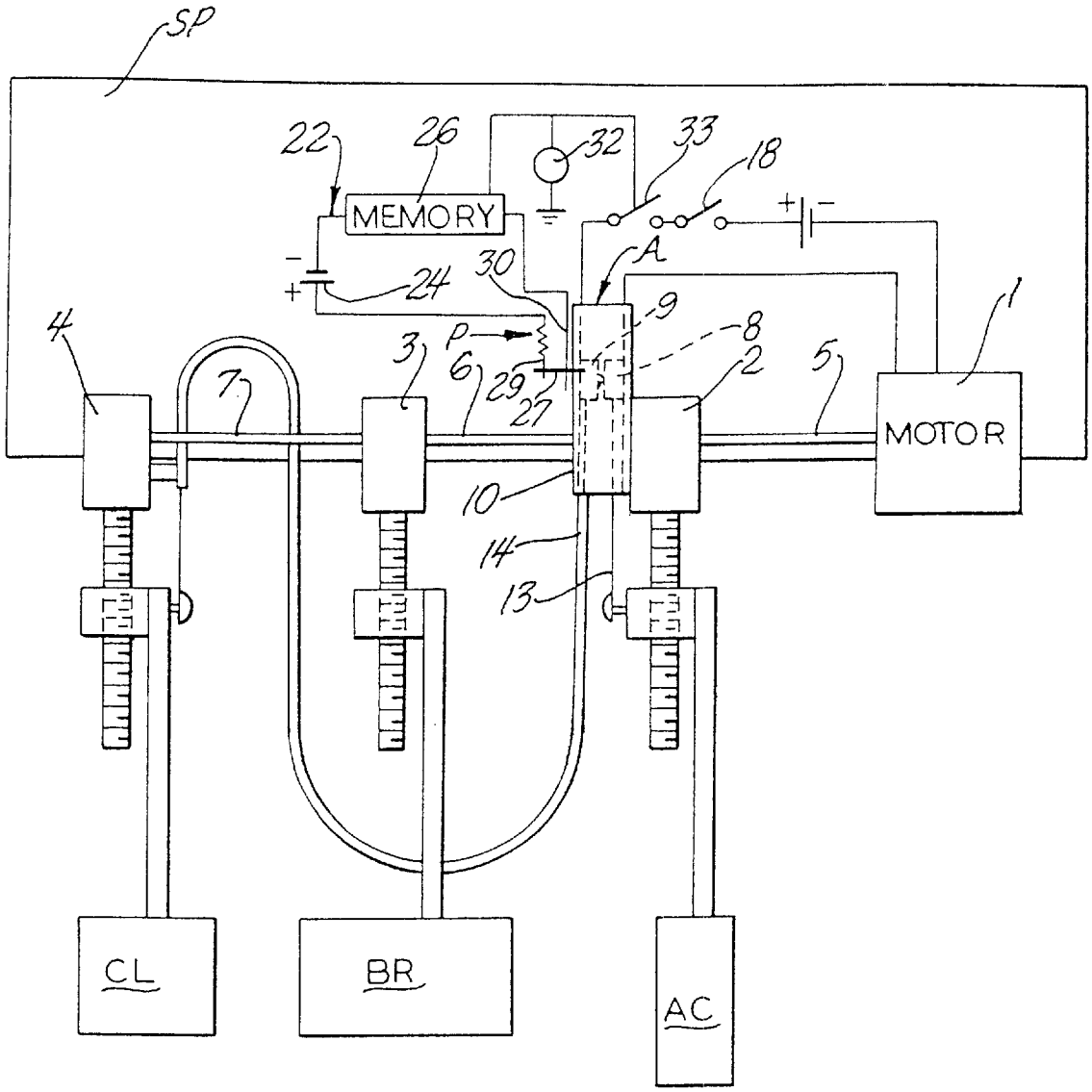
FIG. 4 is a schematic plan view of a modified adjustable pedal system equipped with a memory circuit in accordance with the invention.

Referring now to FIGS. 4 and 5, a modified adjustable pedal system of the invention is shown. The modified system includes a memory circuit 22 in addition to the components of the system shown in FIGS. 1, 2 and 3. The common components of the two systems are identified by the same numerals.

The memory circuit 22 includes an electrical power source such as a battery 24 and a pedal memory module 26 that receives and processes a memory control signal that is generated by a potentiometer P that is associated with switch assembly A that shuts down motor 1 when pedal misalignment requires a shut down as explained above.

More specifically, potentiometer P is incorporated in switch assembly A as shown in FIG. 5. Switch assembly cover 28 has a resistive strip 29 and a parallel laterally spaced conducting rail 30 glued or otherwise suitably secured to an inner surface of cover 28. Slide 9 carries a contact brush 27. When pedals AC, BR and CL are adjusted fore and aft contact brush 27 slides on resistive strip 29 and conducting rail 30 changing the working length and the voltage signal of the potentiometer in accordance with the fore and aft position of the pedals AC and CL. Potentiometer P feeds the voltage signal into the pedal memory module 26 where various settings are or can be stored. The input voltage signal is then processed and compared with the stored settings to produce an output signal which includes a indicating component and/or a control component. The indicating component can be used to operate a signal light or horn 32 indicating a particular driver's preferred pedal position has been achieved. The control component can be used to shut the motor 1 down for instance by opening a normally closed switch 33 in the motor control circuit or operating a relay switch in a conventional motor control circuit.

In the adjustable pedal system described above, the pedals AC, BR and CL are pivotally to the nuts N of the respective jack screws 2, 3 and 4 by lever arms forming part of the respective pedal. However, the pedals can be immovable fixed to the nuts N depending on the mechanism that adjusts the positions of the pedals. See for instance, the Rixon '302 patent discussed above. In other words, although the preferred embodiments of the present invention have been disclosed, various changes and modifications may be made thereto by one skilled in the art without departing from the scope and spirit of the invention as set forth in the appended claims. It is also understood that the terms used herein are merely descriptive, rather than limiting, and that various changes may be made without departing from the scope and spirit of the invention.

We claim:

1. An adjustable pedal system comprising, a first pedal attached to a first moveable member of a first actuator for adjusting position of the first pedal in a fore and aft direction, a second pedal attached to a second moveable member of a second actuator for adjusting position of the second pedal in the fore and aft direction, motor means drivingly connected to the first actuator and the second actuator for driving the first and the second moveable members in the fore and aft direction, the first actuator being driven via a first drive member and the second actuator being driven via a second drive member, means to maintain the position of the first pedal with respect to the position of the second pedal in the fore and aft direction within a predetermined limit in the event that one of the first and second drive members breaks while another of the first and second drive members remains intact during pedal adjustment.

2. The adjustable pedal system as defined in claim 1 further including memory means comparing the position of one of the first pedal and the second pedal with a preselected position of the one of the first pedal and the second pedal.

3. The adjustable pedal system as defined in claim 1 wherein:

the motor means includes an electric motor, the means to maintain position of the first pedal with respect to the second pedal includes a switch assembly in an electrical circuit that controls operation of the electric motor, the switch assembly has a first conducting rail and a second conducting rail, and means drivingly connected to the first and second moveable members that bridge the first and second conducting rails to feed electrical power to the electric motor when the first pedal and the second pedal are aligned and that interrupt electrical power to the electric motor when the first and the second pedals are out of alignment by a predetermined distance.

4. The adjustable pedal system as defined in claim 3 wherein the means drivingly connected to the first and second moveable members comprise a first slide and a second slide disposed in a housing of the switch, the first slide and the second slide each have a first conducting portion contacting the first conducting rail and the second conducting rail respectively, and the first slide and the second slide each have a second conducting portion contacting the second conducting portion of the other slide when the first slide and the second slide are aligned, the first slide and the second slide are drivingly connected to the first and the second moveable members of the first and second actuators respectively so that the relative positions of the first and second slides in the housing correspond to the relative positions of the first and second moveable members of the respective first and second actuators, and the second contact portions of the first and the second slides break contact with each other when the respective positions of the first and second slides are out of alignment by the predetermined distance to interrupt electrical power to the electric motor.

5. The adjustable pedal system as defined in claim 4 wherein the first slide and the second slide are biased toward one end of the housing by first and second coil springs respectively, that are arranged on parallel centerlines in the housing.

6. The adjustable pedal system as defined in claim 4 further including a memory circuit that includes a potentiometer, the potentiometer having a brush contact on one of the first slide and the second slide that engages a resistance strip and a parallel conducting rail of the memory circuit.

7. The adjustable pedal system as defined in claim 4 wherein the first slide and the second slide are biased toward one end of the housing by first and second coil springs respectively, that are arranged on parallel centerlines in the housing.

8. An adjustable pedal system comprising, a first pedal pivotally attached to a first translatable nut of a first jack screw actuator for adjusting position of the first pedal in a fore and aft direction, a second pedal pivotally attached to a second translatable nut of a second jack screw actuator for adjusting position of the second pedal in the fore and aft direction, an electric motor drivingly connected to the first jack screw actuator and the second jack screw actuator for driving the first and the second translatable nuts in the fore and aft direction, the first jack screw actuator being driven via a first drive member and the second jack screw being driven via a second drive member, and means including a switch assembly in an electrical circuit that controls operation of the electric motor to maintain the position of the first pedal with respect to the position of the second pedal in the fore and aft direction within a predetermined limit in the event that one of the first and second drive members breaks while another of the first and second drive members remains intact during pedal adjustment.

9. The adjustable pedal system as defined in claim 8, wherein:

the switch assembly has a first slide and a second slide disposed in a housing, the housing has first and second internal conducting rails, the first slide and the second slide each have a first conducting portion contacting the first internal conducting rail and the second internal conducting rail respectively, and the first slide and the second slide each have a second conducting portion contacting the second conducting portion of the other slide when the first slide and the second slide are aligned, the first slide and the second slide are drivingly connected to the first translatable nut of the first jack screw actuator and the second translatable nut of the second jack screw actuator respectively so that the relative positions of the first and second slides in the housing correspond to the relative positions of the first and second translatable nuts of the respective first and second jack screw actuators, the first and second internal conducting rails are part of the electrical circuit that controls operation of the electric motor, and the switch assembly interrupts electrical power to the electric motor when the respective positions of the first and the second slides are out of alignment by a predetermined distance, the second contact portions of the first and the second slides breaking contact with each other when the respective positions of the first and second slides are out of alignment by the predetermined distance.

10. The adjustable pedal system as defined in claim 9 wherein the first slide and the second slide are biased toward one end of the housing by first and second coil springs respectively, that are arranged on parallel centerlines in the housing.

11. The adjustable pedal system as defined in claim 9 further including a memory circuit that includes a potentiometer, the potentiometer having a brush contact on one of the first slide and the second slide that engages a resistance strip and a parallel conducting rail of the memory circuit.

12. The adjustable pedal system as defined in claim 8 further including memory means comparing the position of one of the first pedal and the second pedal with a preselected position of the one of the first pedal and the second pedal including a potentiometer.

13. The adjustable pedal system as defined in claim 12 wherein:

the switch assembly has a first slide and a second slide disposed in a housing, the housing has first and second internal conducting rails, the first slide and the second slide each have a first conducting portion contacting the first internal conducting rail and the second internal conducting rail respectively, and the first slide and the second slide each have a second conducting portion contacting the second conducting portion of the other slide when the first slide and the second slide are aligned, the first slide and the second slide are drivingly connected to the first translatable nut of the first jack screw actuator and the second translatable nut of the second jack screw actuator respectively so that the relative positions of the first and second slides in the housing correspond to the relative positions of the first and second translatable nuts of the respective jack screw actuators, the first and second internal conducting rails are part of the electrical circuit that controls operation of the electric motor, and the switch assembly interrupts electrical power to the electric motor when the respective positions of the first and the second slides are out of alignment by a predetermined distance, the second contact portions of the first and the second slides breaking contact with each other when the respective positions of the first and second slides are out of alignment by the predetermined distance.

14. The adjustable pedal system as defined in claim 13 wherein the potentiometer has a brush contact on one of the first slide and the second slide that engages an electrical resistance strip and a conducting rail that is spaced from and disposed parallel to the electrical resistance strip.

15. The adjustable pedal system as defined in claim 14 wherein the electrical resistance strip and the parallel conducting rail are attached to a cover of the housing.

16. An adjustable pedal system comprising, a first pedal pivotally attached to a first translatable nut of a first jack screw actuator for adjusting position of the first pedal in a fore and aft direction, a second pedal pivotally attached to a second translatable nut of a second jack screw actuator for adjusting position of the second pedal in the fore and aft direction, a third pedal pivotally attached to a third translatable nut of a third jack screw actuator for adjusting position of the third pedal in the fore and aft direction, an electric motor being drivingly connected to the first jack screw actuator by a first rotary member, the electric motor being drivingly connected to the second jack screw actuator by a second rotary member via the first jack screw actuator and the first rotary member, and the electric motor being drivingly connected to the third jack screw actuator by a third rotary member via the first and second jack screw actuators and the first and second rotary members for driving the first, the second and the third translatable nuts in the fore and aft direction, and means to maintain the positions of the first pedal, the second pedal and the third pedal with respect to each other in the fore and aft direction including a switch assembly in an electrical circuit that controls operation of the electric motor, the switch assembly having a first slide and a second slide each having a conducting portion contacting the conducting portion of the other when the slides are aligned, the first slide and the second slide being drivingly connected to the first translatable nut and the third translatable nut respectively.

17. An adjustable pedal system comprising, a first pedal pivotally attached to a first translatable nut of a first jack screw actuator for adjusting position of the first pedal in a fore and aft direction, a second pedal pivotally attached to a second translatable nut of a second jack screw actuator for adjusting position of the second pedal in the fore and aft direction, a third pedal pivotally attached to a third translatable nut of a third jack screw actuator for adjusting position of the third pedal in the fore and aft direction, an electric motor being drivingly connected to the first jack screw actuator, the second jack screw actuator and the third jack screw actuator for driving the first nut, the second nut and the third nut in the fore and aft direction, the electric motor being drivingly connected to the first jack screw actuator by a first rotary member and the electric motor being drivingly connected to the second jack screw actuator and the third jack screw actuator via the first jack screw actuator and the first rotary member, and means to maintain the positions of the first pedal, the second pedal and the third pedal with respect to each other in the fore and aft direction including a switch assembly in an electrical circuit that controls operation of the electric motor, the switch assembly having a first slide and a second slide each having a conducting portion contacting the conducting portion of the other when the slides are aligned, the first slide being drivingly connected to the first translatable nut and the second slide being connected to either the second translatable nut or the third translatable nut.

18. An adjustable pedal system comprising, a first pedal attached to a first moveable member of a first actuator for adjusting position of the first pedal in a fore and aft direction, a second pedal attached to a second moveable member of a second actuator for adjusting position of the second pedal in the fore and aft direction, an electric motor drivingly connected to the first actuator and the second actuator for driving the first and the second moveable members in the fore and aft direction, the first actuator being driven via a first rotary cable and the second actuator being driven via a second rotary cable, and means to maintain the position of the first pedal with respect to the position of the second pedal in the fore and aft direction within a predetermined limit in the event that one of the first and second rotary cables breaks while the other rotary cable remains intact during pedal adjustment.

19. The adjustable pedal system as defined in claim 18 wherein:

the means to maintain position of the first pedal with respect to the second pedal includes a switch assembly in an electrical circuit that controls operation of the electric motor, the switch assembly has a first conducting rail and a second conducting rail, and means drivingly connected to the first and second moveable members that bridge the first and second conducting rails to supply electrical power to the electric motor when the first pedal and the second pedal are aligned and that undo the bridge to interrupt electrical power to the electric motor when the first and the second pedals are out of alignment by a predetermined distance.

20. The adjustable pedal system as defined in claim 19 wherein the means drivingly connected to the first and second moveable members comprise a first slide and a second slide disposed in a housing of the switch, the first slide and the second slide each have a first conducting portion contacting the first conducting rail and the second conducting rail respectively, and the first slide and the second slide each have a second conducting portion contacting the second conducting portion of the other slide when the first slide and the second slide are aligned, the first slide and the second slide are drivingly connected to the first and the second moveable members of the first and second actuators respectively so that the relative positions of the first and second slides in the housing correspond to the relative positions of the first and second moveable members of the respective first and second actuators, and the second contact portions of the first and the second slides breaking contact with each other when the respective positions of the first and second slides are out of alignment by the predetermined distance to interrupt electrical power to the electric motor.

* * * * *